US006046119A

United States Patent [19]

Kaibe et al.

[11] Patent Number: 6,046,119

[45] Date of Patent: Apr. 4, 2000

[54] HEAT-RETAINING, MOISTURE-PERMEABLE, WATERPROOF FABRICS

[75] Inventors: Hiroyoshi Kaibe, Osaka; Akira Nishimoto, Otsu; Katsuki Takahashi, Osaka; Shigeki Fukuoka, Otsu, all of Japan

[73] Assignee: Toyo Boseki Kabushiki Kaisha, Osaka, Japan

[21] Appl. No.: 09/238,974

[22] Filed: Jan. 27, 1999

[30] Foreign Application Priority Data

| | | | |
|---|---|---|---|
| Jan. 28, 1998 | [JP] | Japan | 10-015827 |
| Feb. 27, 1998 | [JP] | Japan | 10-047675 |
| Apr. 14, 1998 | [JP] | Japan | 10-102851 |
| Oct. 23, 1998 | [JP] | Japan | 10-301873 |
| Oct. 28, 1998 | [JP] | Japan | 10-307245 |

[51] Int. Cl.[7] ..... B32B 5/18

[52] U.S. Cl. ..... 442/76; 442/85; 442/152; 442/164; 442/417; 428/913

[58] Field of Search ..... 442/76, 85, 152, 442/164, 417; 428/913

[56] References Cited

FOREIGN PATENT DOCUMENTS

| | | |
|---|---|---|
| 60-052675 | 3/1985 | Japan . |
| 60-162641 | 8/1985 | Japan . |
| 63-035887 | 2/1988 | Japan . |
| 1-183579 | 7/1989 | Japan . |
| 3-097970 | 4/1991 | Japan . |

*Primary Examiner*—Christopher Raimund
*Attorney, Agent, or Firm*—Kenyon & Kenyon

[57] ABSTRACT

Disclosed is a heat-retaining, moisture-permeable, waterproof fabric having a highly moisture-absorbing and releasing organic fine particles immobilized on at least one surface of an unprocessed fabric (base fabric) with a moisture-permeable waterproof resin. The fabric is capable of generating heat by the absorption of moisture.

11 Claims, No Drawings

HEAT-RETAINING, MOISTURE-PERMEABLE, WATERPROOF FABRICS

The present invention relates to moisture-permeable, waterproof fabrics capable of generating heat by absorption of moisture, reducing the humidity within clothing and inhibiting moisture condensation, the fabrics being useful for raincoats, sportswears such as wears for mountaineering, athletics, skiing, snowboarding and golf, casual wears such as men's wears, female dresses and coats, outerwears, uniforms for working in refrigerators or cold storage warehouses and so on.

Textile fabric products which require heat-retaining property include, for example, clothes worn in winter such as suits and coats, clothes for protection against cold such as jumpers, winter sportswears such as ski wears, uniforms for working in refrigerators or cold storage warehouses and so on. Various methods have been proposed to improve the heat-retaining property of clothes, as by increasing an air layer using bundles of finer fibers or by incorporating ceramics or metals into fibers to produce a far-infrared ray effect.

The proposed methods for improving the heat-retaining property of clothes include those in which ceramics or metals are incorporated into fibers for far-infrared ray radiations as disclosed in Japanese Unexamined Patent Publication No. 105,107/1988 (a process for producing fiber products) and Japanese Unexamined Patent Publication No. 331,584/1995 (mite-proof, far-infrared ray-irradiated fibers). However, these methods have the drawbacks that the incorporation of ceramics or metals into base fibers lowers the strength of base fibers and colors them.

The proposed methods include those wherein a ceramic- or metal-containing resin is coated or laminated on fibers. Proposed are, for example, sheets of materials having excellent heat-retaining property as disclosed in Japanese Unexamined Patent Publication No. 162,641/1985; coated fabrics as disclosed in Japanese Unexamined Patent Publication No. 35,887/1988; and cloth or paper products coated with ceramics as disclosed in Japanese Unexamined Patent Publication No. 183,579/1989. These methods assure heat-retaining property but fail to reduce the humidity within clothing and to inhibit moisture condensation due to the moisture-absorbing or releasing properties of the additive.

On the other hand, methods of preventing moisture-permeable, waterproof clothes from becoming damp inside and improving dewing inhibition have been proposed. The proposals include waterproof sheets (Japanese Unexamined Patent Publications No. 17,256/1981 and No. 20,679/1981); moisture-absorbing and releasing, waterproof sheets (Japanese Unexamined Patent Publication No. 52,675/1985); air-impermeable, moisture-absorbing and releasing, waterproof sheets (Japanese Unexamined Patent Publications No. 110,440/1985 and No. 126,386/1985); dewing-inhibitory, waterproof sheets (Japanese Unexamined Patent Publication No. 77,530/1989); moisture-permeable, waterproof fabrics (Japanese Unexamined Patent Publication No. 9,631/1995); and fabrics coated with a moisture-absorbing and releasing, waterproof layer (Japanese Unexamined Patent Publication No. 97,970/1991).

The methods heretofore proposed can produce a high dewing inhibitory effect but without positively utilizing the heat generated by absorption of moisture. In other words, fabrics with both functions have not been developed for commercial use.

Directing attention to highly moisture-absorbing and releasing, hygroscopically heat-generating organic fine particles, the present inventors successfully developed moisture-permeable, waterproof fabrics by immobilizing said organic fine particles on an unprocessed (base fabric) using a moisture-permeable resin as an adhesive, said fabrics being capable of generating heat on absorption of such moisture as sweat exuded from the human body and capable of reducing the humidity within clothing and inhibiting dewing due to excellent moisture-absorbing and releasing property of the fine particles.

According to the present invention, there is provided a heat-retaining, moisture-permeable, waterproof fabric having a highly moisture-absorbing and releasing organic fine particles immobilized on at least one surface of an unprocessed fabric (base fabric) with a moisture-permeable waterproof resin, said fabric (processed fabric) being capable of achieving a difference in the hygroscopic degree (ΔA) as represented by the following equation (1) and a difference in the temperature of heat generated by absorption of moisture (ΔT) as represented by the following equation (2):

$$\Delta A = A(95) - A(20) \geqq 3(\%) \quad (1)$$

wherein A (95) represents a moisture absorption ratio (%) of the processed fabric as measured after being left to stand for 24 hours at a relative humidity of 95% (20° C.), and A (20) represents a moisture absorption ratio (%) of the processed fabric as measured after being left to stand for 24 hours at a relative humidity of 20% (20° C.); and $\Delta T = T\text{ (sample)} - T\text{ (blank)} \geqq 0.5$ (°C.) (2) wherein T (sample) represents the surface temperature of the processed fabric as measured after the fabric is absolutely dried, adjusted to a temperature of 32° C. in an absolute dry condition and held for 10 seconds in an environment of 70% RH and 32° C., and T (blank) represents the surface temperature of the unprocessed fabric (base fabric) as measured after the fabric is absolutely dried, adjusted to a temperature of 32° C. in an absolute dry condition and held for 10 seconds in an environment of 70% RH and 32° C.

Preferred embodiments of the present invention are as follows.

1. The heat-retaining, moisture-permeable, waterproof fabric as described above, wherein the difference in the temperature of heat generated by absorption of moisture (ΔT) is in the range of about 1.0 to about 10.0° C.

2. The heat-retaining, moisture-permeable, waterproof fabric as described in item 1, wherein the difference in the temperature of heat generated by absorption of moisture (ΔT) is in the range of about 1.5 to about 8.0° C.

3. The heat-retaining, moisture-permeable, waterproof fabric as described above, wherein the moisture-permeable, waterproof resin containing highly moisture-absorbing and releasing organic fine particles is immobilized in the form of a layer on at least one surface of the unprocessed fabric (base fabric).

4. The heat-retaining, moisture-permeable, waterproof fabric as described above, wherein the highly moisture-absorbing and releasing organic fine particles show an initial moisture-absorbing rate of 0.8%/min or more at 20° C. and 65% RH.

5. The heat-retaining, moisture-permeable, waterproof fabric as described above, wherein the highly moisture-absorbing and releasing organic fine particles have an average particle size of 30 μm or less.

6. The heat-retaining, moisture-permeable, waterproof fabric as described above, wherein the highly moisture-absorbing and releasing organic fine particles are the fine particles of an acrylic resin composed of at least 60% by weight of acrylonitrile as a monomer, the acrylic resin being given a crosslinked structure by hydrazine treatment, and a nitrogen content being increased by 1.0 to 15.0% by weight, at least 1.0 mmol/g of remaining nitrile group being chemically converted to a salt of carboxyl group by hydrolysis.

7. The heat-retaining, moisture-permeable, waterproof fabric as described above, wherein the moisture-permeable, waterproof resin has a moisture permeability of at least 30 $g/m^2$.hr as measured in the form of a 30 $\mu$m-thick film.

8. The heat-retaining, moisture-permeable, waterproof fabric as described in item 7, wherein the moisture-permeable, waterproof resin has a moisture permeability of at least 70 $g/m^2$.hr.

9. The heat-retaining, moisture-permeable, waterproof fabric as described in item 3, wherein a layer of a resin having a thickness of 5 to 50 $\mu$m and a moisture permeability of 10 to 70 $g/m^2$.hr is formed on the layer of said moisture-permeable, waterproof resin containing highly moisture-absorbing and releasing organic fine particles.

10. The heat-retaining, moisture-permeable, waterproof fabric as described above, wherein the amount of the highly moisture-absorbing and releasing organic fine particles is 1 to 100% by weight based on the fibers of the base fabric.

Modes of carrying out the present invention will be described below in more detail.

The term "unprocessed fabric" used herein refers to a base fabric to be used in producing the heat-retaining, moisture-permeable, waterproof fabric of the present invention. Examples of materials of the base fabric useful in the present invention include synthetic fibers such as polyamide fibers, polyester fibers and polyacrylonitrile fibers, semi-synthetic fibers such as rayon and acetate, natural fibers such as cotton and wool. These fibers are used in any form such as woven fabric, knitted fabric or non-woven fabric.

There is no limitation on the moisture-permeable, waterproof resins to be used in the present invention insofar as they have a moisture permeability of at least 30 $g/m^2$.hr as measured according to JIS L 1099, A-1 method (calcium chloride method) when provided in the form of a 30 $\mu$m-thick film and insofar as they are usable in immobilizing highly moisture-absorbing and releasing organic fine particles on the base fabric. Acrylic resins, polyurethane resins and silicone resins are preferred in view of the touch of the obtained fabric. Useful resins are those having a moisture permeability of preferably at least 70 $g/m^2$ hr, more preferably 100 to 300 $g/m^2$.hr. When the resin has a moisture permeability of more than 300 $g/m^2$.hr, heat is abruptly evolved and lasts only for a short time. However, such resin can be used if a short period heat is useful.

When heat is required to last for a prolonged time, even a resin of less than 30 $g/m^2$.hr in moisture permeability can be used.

The duration of generated heat can be extended, for example, by forming on the foregoing resin layer an overcoating of a resin which is free of highly moisture-absorbing and releasing organic fine particles and which has a lower moisture permeability than the underlying resin layer. Preferably the overcoating shows a moisture permeability of 10 to 70 $g/m^2$.hr and has a thickness of 5 to 50 $\mu$m.

According to the present invention, the moisture-permeable, waterproof resin and highly moisture-absorbing and releasing organic fine particles are fixed on the surface of the base fabric, whereby the fabric is rendered heat-retaining, moisture-permeable and waterproof. To improve the moisture permeability and waterproofness, the foregoing resin layer is preferably formed on at least one surface of the base fabric. In this case, preferably the resin layer has a thickness of 2 to 300 $\mu$m.

On absorption of moisture, heat is evolved by a fabric having fixed thereon a moisture-permeable, waterproof resin and highly moisture-absorbing and releasing organic fine particles. The fabric of the invention is required to achieve a difference of at least 3% between the moisture absorption ratios at 95% RH (A (95)) and at 20% RH (A (20)). A preferred difference is about 5 to about 30%. A difference of less than 3% results in insufficient moisture absorption and fails to produce the contemplated results of the present invention.

Highly moisture-absorbing and releasing, hygroscopically heat-generating organic fine particles to be used in the invention can be any of those which are highly hygroscopic and highly moisture-releasable and which can emit heat on absorption of moisture. Among them, preferred organic fine particles are those having a high moisture absorption ratio of 40% or more at 65% RH and an initial moisture-absorbing rate of 0.8%/min or more. These organic fine particles show a high heat-generating rate and excellent property of evolving heat on absorption of moisture. More preferred organic fine particles are those having a moisture absorption ratio of at least 45% and an initial moisture-absorbing rate of about 1.0 to about 10%/min.

However, when the fine particles have an excessive water-absorbing capacity, the film is likely to swell and fine particles tend to come off from the film. Thus, suitable organic fine particles are those having not only said hygroscopicity but a water-absorbing capacity ratio in the range of preferably from 0.4:1 to 10:1, more preferably from 0.6:1 to 4:1.

The term "water-absorbing capacity ratio" used herein refers to a water-absorbing capacity ratio which is given by the following method. Pure water is added to absolutely dried organic fine particles, the blend of water and particles is left to stand for 24 hours, the superfluous water is removed by decantation, and a weight ratio of water in the particles:particles is calculated from the weight of the water-containing particles.

As to moisture releasability, an initial moisture-releasing rate is preferably 0.8%/min or more, more preferably about 1.0 to about 5.0%/min, at 90% RH (20° C.) to 40% RH (20° C.) in view of the effects of reducing the humidity within clothing and preventing dewing by release of absorbed moisture.

The term "initial moisture-absorbing rate" used herein refers to an initial moisture-absorbing rate which is given by the following method. The organic fine particles are vacuum-dried at 70° C. for 12 hours, a moisture absorption ratio is measured after standing for 10 minutes in an atmosphere of 20° C., 65% RH, and a ratio of increase in moisture absorption ratio per minute is calculated.

The term "initial moisture-releasing rate" used herein refers to an initial moisture-releasing rate which is given by the following method. The organic fine particles are left to stand at 20° C., 90% RH for 24 hours for adjustment of humidity, the particles are transferred to an atmosphere of 20° C., 40% RH, the moisture absorption ratio is measured after standing for 10 minutes and a ratio of decrease in moisture absorption ratio per minute is calculated.

Examples of useful highly moisture-absorbing and releasing, hygroscopically heat-generating organic fine particles to be used in the invention are acrylic metal-modified particles containing a metal salt of carboxyl group and having a crosslinked structure introduced by hydrazine treatment of an acrylic resin composed of at least 60% by weight, preferably about 85 to about 99% by weight, of acrylonitrile as a monomer, a nitrogen content being increased by 1.0 to 15.0% by weight, at least 1.0 mmol/g, preferably about 2.0 to 10.0 mmols/g, of remaining nitrile group being chemically converted to a metal salt of carboxyl group by hydrolysis. Useful metals are alkali metals such as sodium and potassium and alkaline earth metals such as calcium.

Highly moisture-absorbing and releasing, hygroscopically heat-generating organic fine particles to be used in the invention are required to have an average particle size of 30 μm or less, preferably 10 μm or less, more preferably 5 μm or less, for the purposes of increasing the moisture-absorbing and releasing rate, preventing the removal of particles from the resin layer and giving a smooth touch to the fabric. Further the fine particles need to have a maximum particle size of 50 μm or less, preferably 20 μm or less, more preferably 10 μm or less, for the same purposes. The fine particles of less than 0.01 μm in average particle size are difficult to handle in drying and in adding a resin and hence are undesirable.

The amount of highly moisture-absorbing and releasing organic fine particles to be used in the invention is an important factor affecting the heat-retaining property. To impart the desired degree of heat-retaining property, the amount of the particles to be used is 1 to 100% by weight, preferably 10 to 50% by weight, more preferably 20 to 40% by weight, based on the weight of the fibers of the base fabric. If the amount of the fine particles to be used is less than 1% by weight, the fabric fails to produce the desired extents of the effects, namely generating heat on absorption of moisture, reducing the humidity within clothing and preventing dewing. On the other hand, if the amount exceeds 50% by weight, the film is impaired in appearance and is noticeably lowered in strength.

To generate heat on absorption of moisture to the extent as contemplated by the present invention, a great temperature difference (ΔT) is preferred. Stated more specifically, a difference of at least 0.5° C. is required between the surface temperature T (blank) of the base fabric (as measured after the base fabric is absolutely dried, adjusted to a temperature of 32° C. in an absolute dry condition and held for 10 seconds in an environment of 70% RH, 32° C.) and the surface temperature T (sample) of the resin layer on the fabric (as measured after the resin-coated fabric is subjected to the same procedure). The temperature difference is preferably about 1.0 to about 10° C., more preferably about 1.5 to about 8.0° C. In the case of a temperature difference of less than 0.5° C., the fabric is not warm to the touch and the contemplated results of the invention can not be produced.

To reduce the humidity within clothing to the desired level of the present invention, the humidity within clothing is preferably 70% or less, more preferably 30 to 65% as measured by the evaluation method to be described later, in view of comfortableness when touched.

To prevent dewing as contemplated by the present invention, the amount of dewing is preferably 23 g/m$^2$ or less, more preferably 20 g/m$^2$ or less as measured according to the evaluation method to be described later, in view of comfortableness when touched.

The moisture-permeable, waterproof resin and the highly moisture-absorbing and releasing organic fine particles can be applied to the base fabric by coating, laminating, dipping, exhausting or other methods. There is no limitation on application methods insofar as they assure the contemplated effects of generating heat on absorption of moisture, reducing the humidity within clothing and preventing dewing. Modes of application to be conducted in the present invention include methods wherein the resin is applied to the fabric by dipping or exhausting, a film incapable of giving said effects is laminated on the resin coating surface of fabric to impart waterproofness, methods wherein a film incapable of giving said effects is laminated on the fabric using the resin as an adhesive, and methods wherein a resin of lower moisture permeability is applied as an undercoat or topcoat on or under a resin film capable of giving said effects in order to control the temperature elevation and heat generating time. Either the so-called dry method or wet method can be used in forming a film by coating or laminating.

According to the invention, a water repellent treatment can be applied to said base fabric. When a resin layer capable of hygroscopically generating heat, reducing the humidity within clothing and inhibiting dewing is formed on the fabric as by coating or laminating, a water repellent treatment can be carried out to control the degree of penetration of a resin solution into the fabric, the resin solution being used as a coating fluid or as an adhesive in laminating. Useful water repellents include, for example, fluorine-containing water repellents, paraffin-based water repellents and so on. However, silicone-type water repellents are not suitable to use because they tend to cause peeling of film. The water repellent treatment can be done after applying the resin to the base fabric. In this case, any of water repellents including fluorine-containing, paraffin-based and silicone-type water repellents can be used.

The present invention will be described below in more detail with reference to the following Examples and Comparative Examples. The properties of fabrics prepared in the Examples and Comparative Examples were evaluated or measured by the following methods.

Difference in Hygroscopic Degree (ΔA, %)

A sample (about 100 g) was dried by hot air at 105° C. for 5 hours and then the weight ($W_0$) was measured. About 100 g of said sample was left to stand in a desiccator at 20% RH (20° C.) for 24 hours and the weight of the sample ($W_1$) was measured, while about 100 g of said sample was left to stand in a desiccator at 95% RH (20° C.) for 24 hours and the weight of the sample ($W_2$) was measured. The moisture absorption ratios, A(20) and A(95), were calculated according to the following equations:

$$A\ (20)=(W_1-W_0)/W_0\ (\%)$$

$$A\ (95)=(W_2-W_0)/W_0\ (\%)$$

$$\Delta A\ (\%)=A\ (95)-A\ (20)$$

Resistance to Water Pressure

Measured according to JIS L 1092 (high water pressure method). Unit: kg/cm$^2$

Moisture Permeability

Measured according to JIS L 1099 (A-1 method). Unit: g/m$^2$.hr

Heat-retaining Property

Four pieces of the fabric were laid in superimposition in an absolute dry condition within a desiccator at 90% RH (20° C.). A thermoelectric thermometer was set on the second piece of the fabric to check the elevation of temperature for 30 minutes. Unit: °C.

Film Strength

A 20 μm-thick film was produced and the strength of the film was measured according to JIS L 1096, bursting strength, A method (Müllen method). Unit: kg.

Difference in Temperature of Heat Generated by Absorption of Moisture (ΔT, °C.)

A resin-coated fabric and a base fabric of the same material and the same weight as the resin-coated fabric were absolutely dried (drying conditions: 120° C., 3 hours) and introduced into a desiccator. Then the desiccator was placed in an environment at 32° C., 70% RH for 10 hours or longer to adjust the temperatures of the fabrics. After the fabrics were withdrawn from the desiccator, the surface temperatures of the fabrics were measured 10 seconds later using THERMO TRACER TH 3100 and DETECTOR UNIT TH 3100 (trade names, manufactured by NEC San-ei Instruments Ltd.). From the values of T (sample) and T (blank) obtained, a difference in the temperature of heat generated by absorption of moisture (ΔT) was calculated according to the following equation:

$$\Delta T = T\text{ (sample)} - T\text{ (blank)}$$

wherein T (sample) is the surface temperature of the fabric with the resin layer (as measured after the fabric is absolutely dried, adjusted to a temperature of 32° C. in an absolute dry condition and held for 10 seconds in an environment of 70% RH, 32° C.), and T (blank) is the surface temperature of the base fabric of the same material and the same weight (as measured after the base fabric is absolutely dried, adjusted to a temperature of 32° C. in an absolute dry condition and held for 10 seconds in an environment of 70% RH, 32° C.).

Humidity Within Clothing (% RH)

The humidity within clothing was measured using a device for simulation of microclimate within clothing which device is disclosed in Japanese Examined Patent Publication No. 19098/1989. The disclosed device comprises (I) a wind-tunnel section for control of external environment conditions inclusive of temperature, humidity and air current, (II) a section for reproducing the conditions of human body, and (III) a section comprising artificial skin and clothes for reproducing the microclimate within clothing.

Measuring conditions:

(i) external environment temperature: 8° C., 55% RH, (ii) wind-tunnel section environment: the outside air at 55% RH and 8° C. was introduced at a wind rate of 1 m/sec using an air blower and a rectifier, and (iii) section for reproducing the conditions of human body;

(a) material for artificial human skin: polytetrafluoroethylene film (pore diameter 5 μm), (b) surface temperature of artificial human skin: 37° C., and (c) amount of perspiration: 200 g/m$^2$.hr (determined in terms of the amount of water being reduced in a box without use of artificial human skin nor the sample), and (iv) section for reproducing the microclimate within clothing: 6 mm in spacing between the sample and the artificial human skin.

The sample was absolutely dried under the same conditions as in measuring the temperature of heat generated by absorption of moisture (120° C., 3 hours), placed into a desiccator, adjusted to a specific temperature by standing in an environment at 32° C. and 70% RH for 10 hours or longer, withdrawn from the desiccator, arranged to direct the resin-coated surface of the fabric toward the artificial human skin. Then the measurement of humidity within clothing was commenced by a temperature-humidity sensor.

After sweating for 30 minutes under said conditions, the section for reproducing the microclimate within clothing was taken out, a moisture-impermeable film (Saran Wrap, trade name for product of Asahi Chemical Industry Co., Ltd.) was accommodated in a combination of the section for reproducing the conditions of human body and the section for reproducing the microclimate within clothing, followed by cease of sweating. Then the section for reproducing the microclimate within clothing was set again, followed by cease of sweating for 30 minutes, to complete the measurement. The maximum humidity value was indicated as a representative value of measurements of humidity within clothing.

Amount of Dewing

The sample was taken out immediately after measuring the microclimate within clothing. Thereafter water droplets were wiped off from the fabric surface directed to the artificial human skin. The amount of dewing was measured based on the change in the weight of fabric used for wiping. The amount of dewing was expressed in terms of weight per square meter (unit: g/m$^2$).

Organoleptic Evaluation (Comfortableness)

A fabric with a resin layer was cut to a piece, 20 cm in width and 30 cm in length, in an environment of 8° C., 55% RH. Then the piece of fabric was wound around a panelist's arm with the resin-coated surface of fabric turned inside. The end of the winding was attached to the underlying winding portion with a surgical tape. The panelist took exercise which consumed 150 kcal. (heart rate 127) as measured with an ergometer (TAKEI AERO FITNESS cutie). The comfortableness of the fabric was evaluated in terms of warmness and dampness according to the following 5-grade ratings.

5: comfortable

4: a little comfortable

3: normal

2: a little uncomfortable

1: uncomfortable.

PREPARATION EXAMPLES FOR PREPARING HIGHLY MOISTURE-ABSORBING AND RELEASING ORGANIC FINE PARTICLES

Preparation Example 1

Into an autoclave were placed 450 parts by weight of acrylonitrile, 40 parts by weight of methyl acrylate, 16 parts by weight of sodium parastyrene sulfonate and 118 parts by weight of water. Di-tert-butyl peroxide was added in an amount of 0.5% by weight based on the total amount of the monomers. After the autoclave was closed, the mixture was polymerized with stirring at 150° C. for 20 minutes. After completion of the reaction, the reaction product was cooled to about 90° C. with stirring, giving an aqueous dispersion of fine particles having an average particle size of 2 μm (as measured with a light scattering photometer).

Hydrazine was added to the aqueous dispersion to give a concentration of 35% by weight in the bath. The mixture was subjected to crosslinking procedure at 102° C. for 2.5 hours. Then NaOH was added to give a concentration of 10% by weight in the bath. The mixture was hydrolyzed at 102° C. for 5 hours, dialyzed in flowing water, desalted and dried, giving highly moisture-absorbing and releasing organic fine particles. The fine particles thus obtained (hereinafter called "highly moisture-absorbing and releasing organic fine particles (P)") had a nitrogen content increased by 3.3% by weight and an average particle size of 2 μm, contained 4.3 mmols/g of a salt of carboxyl group and showed a moisture absorption ratio of 45% at 65% RH (20° C.).

Highly moisture-absorbing and releasing organic fine particles (P) were vacuum-dried at 70° C. for 12 hours and showed moisture absorption ratios of 10% after standing for 10 minutes in a desiccator at 65% RH (20° C.) and 45% after standing therein for 24 hours.

Highly moisture-absorbing and releasing organic fine particles (P) showed moisture absorption ratios of 86% after standing for 24 hours in a desiccator at 90% RH (20° C.); 68% after standing for 10 minutes in a desiccator at 40% RH (20° C.); and 28% after standing for 1 hour in the same desiccator. These data confirmed that the particles (P) had the desired highly moisture-absorbing and releasing properties. The particles (P) showed a water-absorbing capacity ratio of 2.5.

Preparation Example 2

The same procedure as in Preparation Example 1 was repeated with the exception of using acrylonitrile, methyl methacrylate, methacrylic acid and sodium para-styrene sulfonate in a weight ratio of 64/27/7/2. The procedure gave highly moisture-absorbing and releasing organic fine particles (Q) having nitrogen increased by 3.6% by weight and an average particle size of 15 μm and containing 4.7 mmols/g of a salt of carboxyl group.

The particles (Q) showed moisture absorption ratios of 46% at 65% RH, 80% at 90% RH and 33% after standing for 1 hour at 40% RH, and an initial moisture-absorbing rate of 0.8%/min. The particles (Q) had a water-absorbing capacity ratio of 2.3.

Preparation Example 3

The same procedure as in Preparation Example 1 was repeated with the exception of using acrylonitrile and sodium parastyrene sulfonate in a 96/4 weight ratio. The procedure gave highly moisture-absorbing and releasing organic fine particles (R) having a nitrogen content increased by 4.0% by weight and an average particle size of 5 μm and containing 5.3 mmols/g of a salt of carboxyl group.

The particles (R) showed moisture absorption ratios of 50% at 65% RH, 83% at 90% RH and 30% after standing for 1 hour at 40% RH, and an initial moisture-absorbing rate of 0.9%/min. The particles (R) had a water-absorbing capacity ratio of 2.6.

Examples 1–5 and Comparative Examples 1–5

A woven fabric was produced by weaving nylon filament yarns composed of 50 d/48 f at a pick spacing of 112 yarns/inch and an end spacing of 175 yarns/inch. Then the fabric was dyed with an acidic dye by a Jigger dyeing machine. The dyed fabric was treated with a fluorine-containing water repellent (Asahi Guard 710, product of Asahi Glass Co.) at 1% owf by a pad dry process and heat-treated at 160° C. for 1 minute. The fabric was subjected to calendering at 170° C. under a pressure of 30 kg/cm$^2$ to produce a base fabric to be coated.

The obtained base fabric was coated with a solution comprising the highly moisture-absorbing and releasing organic fine particles, resin, solvent and additives shown below in Tables 1–3 in the indicated amounts. The amounts of particles and other materials were expressed in part by weight.

The trade names appearing in the tables show the following:

Hi-muren Y-237 is a trade name for a polyurethane resin manufactured by Dainichi Seika Color & Chemicals MGF. Co., Ltd.

Resamine X-100 is a trade name for a crosslinking agent (manufactured by Dainichi Seika Color & Chemicals MGF. Co., Ltd.) for polyurethane resins.

Paracron AM-200 is a trade name for an acrylic resin manufactured by Negami Kogyo Co., Ltd.

Panron LN is a trade name for a crosslinking agent (manufactured by Negami Kogyo Co., Ltd.) for acrylic resins.

Paracron PE-30 is a trade name for a silicone resin manufactured by Negami Kogyo Co., Ltd.

Catalyst C46 is a trade name for a catalyst (manufactured by Negami Kogyo Co., Ltd.) for silicone resins.

TABLE 1

| | Ex.1 | Ex.2 | Comp. Ex.1 |
|---|---|---|---|
| Hi-muren Y-237 | 100 | 100 | 100 |
| Methyl ethyl ketone | 20 | 20 | 20 |
| Resamine X-100 | 2 | 2 | 2 |
| Highly moisture-absorbing and releasing organic fine particles (P) | 5 | 30 | 0 |

TABLE 2

| | Ex.3 | Ex.4 | Comp. Ex.2 |
|---|---|---|---|
| Paracron AM-200 | 100 | 100 | 100 |
| Toluene | 10 | 20 | 20 |
| Panron LN | 2 | 2 | 2 |
| Highly moisture-absorbing and releasing organic fine particles (P) | 5 | 30 | 0 |

TABLE 3

| | Comp. Ex.3 | Comp. Ex.4 | Comp. Ex.5 |
|---|---|---|---|
| Paracron PE-30 | 100 | 100 | 100 |
| Catalyst C46 | 2 | 2 | 2 |
| Ethyl acetate | 20 | 20 | 20 |
| Highly moisture-absorbing and releasing organic fine particles (P) | 5 | 30 | 0 |

Solutions were prepared with concentrations in solvents adjusted to a viscosity of 10000 cps (as measured with a B-type viscometer, rotor No. 5, number of revolutions 20 rpm). The fabrics were coated with the solutions using an applicator having a clearance of 50 μm. After coating, the coating layer was cured at 130° C. for 1 minute.

Tables 4 and 5 show the results of evaluating the properties of the coated fabrics.

TABLE 4

| Property | Example 1 | 2 | 3 | 4 |
|---|---|---|---|---|
| Resistance to water pressure ($kg/m^2$) | 1.5 | 1.0 | 0.5 | 0.4 |
| Moisture permeability ($g/m^2 \cdot hr$) | 150 | 200 | 70 | 85 |
| Heat-retaining property (° C.) | 1 | 2 | 0.8 | 1.1 |
| Film strength (kg) | 0.5 | 0.3 | 0.4 | 0.4 |
| Difference in hygroscopic degree (ΔA, %) | 9.0 | 12.1 | 6.0 | 9.1 |
| Difference in temperature of heat generated by absorption of moisture (ΔT, ° C.) | 1.8 | 3.9 | 1.2 | 2.5 |

TABLE 5

| Property | Comparative Example 1 | 2 | 3 | 4 | 5 |
|---|---|---|---|---|---|
| Resistance to water pressure ($kg/m^2$) | 1.7 | 0.6 | 1.2 | 1.1 | 1.5 |
| Moisture permeability ($g/m^2 \cdot hr$) | 143 | 62 | 20 | 22 | 15 |
| Heat-retaining property (° C.) | 0 | 0 | 0 | 0.1 | 0 |
| Film strength (kg) | 0.5 | 0.4 | 0.7 | 0.5 | 0.4 |
| Difference in hygroscopic degree (ΔA, %) | 2.4 | 2.3 | 2.2 | 2.9 | 1.8 |
| Difference in temperature of heat generated by absorption of moisture (ΔT, ° C.) | 0 | 0 | 0 | 0 | 0 |

Example 5

A coated fabric was produced by the same procedure as in Example 2 with the exception of using highly moisture-absorbing and releasing organic fine particles (Q) in place of the highly moisture-absorbing and releasing organic fine particles (P). The obtained coated fabric showed a water pressure resistance of 0.8 $kg/m^2$, a moisture permeability of 180 $g/m^2$.hr, a heat-retaining property of 1.5° C., a film strength of 0.3 kg, a difference in hygroscopic degree (ΔA) of 10.1% and a difference in temperature of heat generated by absorption of moisture (ΔT) of 3.6° C.

Examples 6–9

Coated fabrics were produced in Examples 6–9 by the same procedure as in Examples 1 to 4, respectively with the exception of using highly moisture-absorbing and releasing organic fine particles (R) in place of the highly moisture-absorbing and releasing organic fine particles (P).

Solutions were prepared with concentrations in solvents to a viscosity of 13000 cps (as measured with a B-type viscometer, rotor No.5, number of revolutions 20 rpm). The fabrics were coated with the solutions using an applicator having a clearance of 80 μm. After coating, the coating layer was cured at 130° C. for 1 minute. The results of evaluation are shown in Table 6.

TABLE 6

| Property | Example 6 | 7 | 8 | 9 |
|---|---|---|---|---|
| Resistance to water pressure ($kg/cm^2$) | 1.7 | 1.0 | 0.5 | 0.6 |
| Moisture permeability ($g/m^2 \cdot hr$) | 130 | 180 | 70 | 92 |

TABLE 6-continued

| Property | Example 6 | 7 | 8 | 9 |
|---|---|---|---|---|
| Thickness of resin layer (μm) | 25 | 28 | 20 | 22 |
| Difference in hygroscopic degree (ΔA, %) | 7.5 | 9.5 | 5.5 | 7.8 |
| Heat-retaining property (° C.) | | | | |
| 3 minutes later | 2.1 | 2.8 | 1.7 | 2.5 |
| 10 minutes later | 1.1 | 2.0 | 1.5 | 2.0 |
| 30 minutes later | 0.9 | 1.0 | 0.9 | 1.0 |
| Difference in temperature of heat generated by absorption of moisture (ΔT, ° C.) | 1.7 | 3.6 | 1.1 | 2.4 |

Examples 10–13

Coated fabrics were produced in Examples 10 to 13 in the same manner as in Examples 6 to 9, respectively with the exception of using an applicator having a clearance of 220 μm. The properties of the obtained coated fabrics were evaluated with the results shown in Table 7.

TABLE 7

| Property | Example 10 | 11 | 12 | 13 |
|---|---|---|---|---|
| Resistance to water pressure ($kg/cm^2$) | 1.7 | 1.0 | 0.5 | 0.6 |
| Moisture permeability ($g/m^2 \cdot hr$) | 130 | 180 | 70 | 92 |
| Thickness of resin layer (μm) | 66 | 70 | 58 | 62 |
| Difference in hygroscopic degree (ΔA, %) | 8.0 | 9.5 | 6.3 | 8.0 |
| Heat-retaining property (° C.) | | | | |
| 3 minutes later | 2.6 | 3.2 | 1.7 | 2.4 |
| 10 minutes later | 2.1 | 3.0 | 1.7 | 2.2 |
| 30 minutes later | 1.8 | 2.9 | 1.6 | 2.2 |
| Difference in temperature of heat generated by absorption of moisture (ΔT, ° C.) | 3.2 | 4.4 | 1.4 | 2.8 |

Example 14

A solution containing 100 parts by weight of Hi-muren Y-237, 20 parts by weight of MEK and 2 parts by weight of Resamine X-100 was applied to the coated fabric of Example 7. The properties of the obtained fabric were evaluated. The evaluation results are shown below in Table 8.

Example 15

A solution containing 200 parts by weight of Paracron AM-200, 20 parts by weight of toluene and 2 parts by weight of Panron LN was applied to the coated fabric of Example 9. The properties of the obtained fabric were evaluated. The evaluation results are shown in Table 8.

TABLE 8

| Property | Example 14 | 15 |
|---|---|---|
| Resistance to water pressure ($kg/cm^2$) | 2.0 | 0.6 |
| Moisture permeability ($g/m^2 \cdot hr$) | 120 | 60 |

TABLE 8-continued

| Property | Example 14 | Example 15 |
|---|---|---|
| Thickness of resin layer (μm) | 45 | 40 |
| Difference in hygroscopic degree (ΔA, %) | 6.7 | 5.0 |
| Heat-retaining property (° C.) | | |
| 3 minutes later | 0.8 | 0.5 |
| 10 minutes later | 1.5 | 1.1 |
| 30 minutes later | 2.0 | 1.8 |
| Difference in temperature of heat generated by absorption of moisture (ΔT, ° C.) | 0.8 | 0.5 |

The following materials were used in Examples 16–19 and Comparative Examples 6–9 to be described later.

Paracron SS-2500 (trade name for an acrylic resin manufactured by Negami Kogyo Co., Ltd., solid content 20% by weight, toluene used as a solvent).

Panron LN (trade name for a crosslinking agent manufactured by Negami Kogyo Co., Ltd. for acrylic resins).

Urethane resin A (prepared by copolymerizing in the conventional manner polytetramethylene glycol (molecular weight 1000), polyethylene glycol (molecular weight 1000), neopentyl glycol and metaxylylene diisocyanate in a 70/30/16/63 weight ratio, solid content 25% by weight, methyl ethyl ketone used as a solvent, viscosity 50000 cps).

Example 16

A solution was prepared as follows. Paracron SS-2500 (100 parts by weight) was uniformly mixed with 13.3 parts by weight of highly moisture-absorbing and releasing organic fine particles (P). The mixture was diluted with toluene to a viscosity of 10000 cps.

Immediately before coating, 2 parts by weight of Panron LN was added. Then the fabric was coated with the solution by an applicator having a clearance of 35 μm. The coating film was dried at 80° C. for 3 minutes and cured at 130° C. for 3 minutes to produce a moisture-permeable, waterproof fabric. The proportion of highly moisture-absorbing and releasing organic fine particles (P) in the resin layer on the fabric was 40% by weight (as calculated) based on the weight of the fibers.

Example 17

A moisture-permeable, waterproof fabric was produced by the same procedure as in Example 16 except that the amount of highly moisture-absorbing and releasing organic fine particles (P) was changed to 5 parts by weight. The proportion of highly moisture-absorbing and releasing organic fine particles (P) in the resin layer on the fabric was 20% by weight (as calculated) based on the weight of the fibers.

Comparative Example 6

A moisture-permeable, waterproof fabric was produced by the same procedure as in Example 16 with the exception of not using highly moisture-absorbing and releasing organic fine particles.

Comparative Example 7

A solution was prepared as follows. Paracron SS-2500 (100 parts by weight) was uniformly mixed with 13.3 parts by weight of silica gel (silica gel blue manufactured by NAKAMURA CHEMICAL CO., LTD., medium-size particles, average particle size 2.2 μm, crushed to a maximum particle size of 9 μm). The mixture was diluted with toluene to a viscosity of 10000 cps.

Immediately before coating, 2 parts by weight of Panron LN was added. Then the fabric was coated with the solution by an applicator having a clearance of 35 μm. The coating surface was dried at 80° C. for 3 minutes and cured at 130° C. for 3 minutes to produce a moisture-permeable, waterproof fabric. The proportion of silica gel in the resin layer on the fabric was 40% by weight (as calculated) based on the weight of the fibers.

Table 9 below shows the composition and the properties of the moisture-permeable, waterproof fabrics prepared in Examples 16 and 17 and Comparative Examples 6 and 7.

TABLE 9

| | Ex. 16 | Ex. 17 | Comp. Ex. 6 | Comp. Ex. 7 |
|---|---|---|---|---|
| Composition | | | | |
| Highly moisture-absorbing and releasing organic fine particles (wt %) | 40 | 20 | 0 | 0 |
| Silica gel (wt %) | 0 | 0 | 0 | 40 |
| Resin (g/m$^2$, when dried) | 7.0 | 6.5 | 5.8 | 7.2 |
| Property | | | | |
| Difference in hygroscopic degree (ΔA, %) | 10.3 | 8.6 | 2.2 | 4.7 |
| Heat-retaining property (° C.) | 1.1 | 0.9 | 0 | 0.3 |
| Difference in temperature of heat generated by absorption of moisture (ΔT, ° C.) | 2.8 | 1.5 | 0 | 0.6 |
| Humidity within clothing (% RH) | 60 | 64 | 75 | 72 |
| Amount of dewing (g/m$^2$) | 0 | 20 | 50 | 35 |
| Moisture permeability (g/m$^2$ · hr) | 208 | 142 | 83 | 133 |
| Water pressure resistance (kgf/cm$^2$) | 0.49 | 0.55 | 0.65 | 0.47 |
| Comfortableness in organoleptic evaluation | 5 | 4 | 1 | 2 |

As shown in Table 9, when using 20% by weight or more of highly moisture-absorbing and releasing organic fine particles, the resulting fabric showed a great difference in temperature of heat generated by absorption of moisture, a lower humidity within clothing, a reduced amount of dewing, an enhanced moisture permeability and excellent comfortableness as compared with a fabric free of such organic particles. When silica gel was added, the obtained fabric afforded good results in some properties but gave only slight comfortableness when touched. This disadvantage is presumably attributable to lower capabilities of silica gel (moisture content 30% at 65% RH, initial moisture-absorbing rate 0.6%/min, and initial moisture-releasing rate 0.5%/min) than highly moisture-absorbing and releasing organic fine particles.

Example 18

A solution was prepared as follows. One hundred parts by weight of a stock solution of urethane resin A was uniformly mixed with 16.7 parts by weight of highly moisture-absorbing and releasing organic fine particles (P). The mixture was diluted with methyl ethyl ketone to a viscosity of 10000 cps.

Then the base fabric was coated with the solution by an applicator having a clearance of 35 μm. The coating film was dried at 80° C. for 3 minutes and cured at 130° C. for 3 minutes to produce a moisture-permeable, waterproof fabric. The proportion of highly moisture-absorbing and releasing organic fine particles (P) in the resin layer on the fabric was 40% by weight based on the weight of the fibers.

Example 19

A moisture-permeable, waterproof fabric was produced by the same procedure as in Example 18 except that the amount of highly moisture-absorbing and releasing organic fine particles (P) was changed to 6.3 parts by weight. The proportion of highly moisture-absorbing and releasing organic fine particles (P) in the resin layer on the fabric was 20% by weight (as calculated) based on the weight of the fibers.

Comparative Example 8

A moisture-permeable, waterproof fabric was produced by the same procedure as in Example 18 with the exception of not using highly moisture-absorbing and releasing organic fine particles.

Comparative Example 9

A solution was prepared as follows. One hundred parts by weight of a stock solution of urethane resin A was uniformly mixed with 16.7 parts by weight of the silica gel used in Comparative Example 7. The mixture was diluted with methyl ethyl ketone to a viscosity of 10000 cps.

Then the fabric was coated with the solution by an applicator having a clearance of 35 $\mu$m. The coating film was dried at 80° C. for 3 minutes and cured at 130° C. for 3 minutes to produce a moisture-permeable, waterproof fabric. The proportion of silica gel in the resin layer on the fabric was 40% by weight based on the weight of the fibers.

Table 10 below shows the composition and the properties of the moisture-permeable, waterproof fabrics prepared in Examples 18 and 19 and Comparative Examples 8 and 9.

TABLE 10

| | Ex. 18 | Ex. 19 | Comp. Ex. 8 | Comp. Ex. 9 |
|---|---|---|---|---|
| Composition | | | | |
| Highly moisture-absorbing and releasing organic fine particles (wt %) | 40 | 20 | 0 | 0 |
| Silica gel (wt %) | 0 | 0 | 0 | 40 |
| Resin (dry) (g/m$^2$) | 8.0 | 7.3 | 6.9 | 8.4 |
| Property | | | | |
| Difference in hygroscopic degree (ΔA, %) | 11.7 | 9.2 | 2.3 | 4.9 |
| Heat-retaining property (° C.) | 1.4 | 1.0 | 0 | 0.4 |
| Difference in temperature of heat generated by absorption of moisture (ΔT, ° C.) | 3.0 | 1.6 | 0 | 0.7 |
| Humidity within clothing (% RH) | 58 | 63 | 73 | 71 |
| Amount of dewing (g/m$^2$) | 0 | 15 | 40 | 30 |
| Moisture permeability (g/m$^2$ · hr) | 229 | 188 | 125 | 179 |
| Water pressure resistance (kgf/cm$^2$) | 0.60 | 0.63 | 0.70 | 0.55 |
| Comfortableness in organoleptic evaluation | 5 | 5 | 2 | 3 |

As clear from Examples 16 and 17 and Comparative Examples 6 and 7 in Table 10, when using 20% by weight or more of highly moisture-absorbing and releasing organic fine particles, the resulting fabric showed a great difference in temperature of heat generated by absorption of moisture, a lower humidity within clothing, a reduced amount of dewing, an enhanced moisture permeability and excellent comfortableness as compared with a fabric free of such organic particles. When silica gel was added, the obtained fabric afforded good-results in some properties but gave only slight comfortableness when touched. In the case of 80% by weight of silica gel, the fabric was hard to the touch and had a resin layer with low abrasion resistance because of a large amount of silica particles used relative to the resin. Thus, the fabric is not commercially practical.

Examples 20 and 21 and Comparative Example 10

A fabric to be treated was produced by weaving nylon filament yarns composed of 50 d/48 f at a pick spacing of 112 yarns/inch and an end spacing of 175 yarns/inch and dyeing the fabric with an acidic dye by a Jigger dyeing machine. The dyed fabric was treated with the materials having the composition shown in Table 11 using a usual padding mangles at a mangle expression of 80% by a 1-dip 1-nip method, followed by drying at 100° C. Thereafter the fabric was heat-treated at 130° C. for 5 minutes. The amount of the materials is expressed in part by weight in Table 11. The trade names indicate the following materials.

Elastron F-29 is a trade name for water-soluble polyurethane manufactured by Dai-ichi Kogyo Seiyaku Co., Ltd. with a solid content of 30% by weight.

Catalyst 32 is a trade name for a catalyst manufactured by Dai-ichi Kogyo Seiyaku Co., Ltd. Toresin FS-350 is a trade name for water-soluble nylon manufactured by Teikoku Chemical Industries Co., Ltd. with a solid content of 30% by weight.

AS-20 is a trade name for amino-modified silicone manufactured by Hiramatsu Yuka Kogyo Co., Ltd. with a solid content of 30% by weight.

TABLE 11

| | Ex. 20 | Ex. 21 | Comp. Ex. 10 |
|---|---|---|---|
| Composition | | | |
| Highly moisture-absorbing and releasing organic fine particles (P) | 5 | 20 | — |
| Elastron F-29 | 8 | 8 | 8 |
| Catalyst 32 | 0.5 | 0.5 | 0.5 |
| Property | | | |
| Heat-retaining property (° C.) | 0.8 | 1.5 | 0 |
| Difference in hygroscopic degree (ΔA, %) | 8.5 | 10.8 | 7.2 |
| Difference in temperature of heat generated by absorption of moisture (ΔT, ° C.) | 0.6 | 1.2 | — |

Resins B, C and D and Catalysts B' and C' used in Examples 22 and 23 and Comparative Examples 11 and 12 to be described later refer to the following resins and catalysts:

Resin B: self-crosslinking acrylic resin, solid concentration 30% by weight, moisture permeability 60 g/m$^2$ hr.

Catalyst B': catalyst for Resin B (inorganic metal type).

Resin C: water-soluble polyurethane resin, solid concentration 30% by weight, moisture permeability 100 g/m$^2$.hr (as measured for the film prepared from a 16:1 mixture of Resin C and Catalyst C').

Catalyst C': catalyst for Resin C (isocyanate type), solid concentration 100% by weight.

Resin D: silicone resin, solid content 30% by weight, moisture permeability 20 g/m$^2$.hr.

Example 22

6-nylon fibers (2 denier and fiber length 38 mm) and polyester fibers (2 denier and fiber length 38 mm) were subjected to opening and fiber blending procedures (blending ratio 80/20) by opening machines. A web was formed using cards and was laminated into cross layers. Thereafter the web was subjected to thermocompression bonding by calender rolls (200° C., linear pressure 80 kgf/cm$^2$, velocity 30 m/min) to give a non-woven fabric weighing 26 g/m$^2$ and having a thickness of 2 mm and a lengthwise strength of 2.0 kgf/5 cm. The non-woven fabric was treated with an aqueous dispersion of highly moisture-absorbing and releasing organic fine particles (P) (average particle size 2 $\mu$m), Resin B and Catalyst B', using usual padding mangles at a mangle expression of 80% by a 1-dip 1-nip method, followed by drying at 100° C. for 3 minutes. Thereafter the fabric was heat-treated at 130° C. for 5 minutes to give a processed fabric. The amounts of the resin, catalyst and fine particles applied to the fabric were 8.0 parts by weight of Resin B, 0. 5 part by weight of Catalyst B' and 5 parts by weight of the fine particles, per 100 parts by weight of the processed fabric, all calculated as solids.

As shown in Table 12 given later, the obtained processed fabric achieved a remarkable degree of heat generation on absorption of moisture as compared with non-woven fabrics free of highly moisture-absorbing and releasing organic fine particles and prevented dewing without the undesired results such as reduction of strength nor removal of fine particles due to rubbing.

Example 23

A processed fabric was produced in the same manner as in Example 22 with the exception of changing the amount of organic fine particles to 20 parts by weight. As apparent from Table 12 below, a highly moisture-absorbing and releasing, hygroscopically heat-generating non-woven fabric with enhanced hygroscopically heat-generating property was obtained by using an increased amount of fine particles.

Comparative Example 11

A processed fabric was produced in the same manner as in Example 22 with the exception of not using the organic fine particles. As apparent from Table 12 below, neither hygroscopic heat generation nor dewing inhibition was not demonstrated by using only the resin and the catalyst.

Comparative Example 12

A processed fabric was produced in the same manner as in Example 22 with the exception of changing the amount of organic fine particles to 0.5 part by weight. As seen from Table 12 below, neither hygroscopic heat generation nor dewing inhibition was not demonstrated when the fine particles were used only in a small amount of less than 1% by weight based on the weight of the fibers.

Table 12 below shows the composition of the fabrics and the properties thereof prepared in Examples 22 and 23 and Comparative Examples 11 and 12.

TABLE 12

| | Ex. 22 | Ex. 23 | Comp. Ex. 11 | Comp. Ex. 12 |
|---|---|---|---|---|
| Composition | | | | |
| Highly moisture-absorbing and releasing organic fine particles (wt. part) | 5 | 20 | 0 | 0.5 |
| Resin B (solid content, wt. part) | 8.0 | 8.0 | 8.0 | 8.0 |
| Catalyst B' (wt. part) | 0.5 | 0.5 | 0.5 | 0.5 |
| Amount of fine particles (based on weight of fibers, wt. %) | 4.8 | 16.6 | 0 | 0.5 |
| Particle size of fine particles ($\mu$m) | 2 | 2 | — | 2 |
| Property | | | | |
| Difference in temperature of heat generated by absorption of moisture (ΔT, ° C.) | 0.7 | 1.4 | 0 | 0 |
| Presence or absence of dewing | Absent | Absent | Present | Present |
| Tensile strength (kgf/5 cm) | 2.1 | 1.9 | 2.0 | 1.9 |
| Removal or drop of particles after rubbing test | None | None | None | None |
| Difference in hygroscopic degree (ΔA, %) | 8.4 | 13.3 | 1.8 | 2.6 |

The presence or absence of dewing, tensile strength and removal or drop of particles after rubbing test were evaluated by the following methods.

Presence or Absence of Dewing

The non-woven fabric to be evaluated was placed in an atmosphere of 20° C. and 65% RH for 24 hours to adjust the humidity. Then the fabric was laid as a cover over the upper opening of a 200 ml beaker containing 100 ml of hot water (50° C.) in the atmosphere of the same temperature and the same humidity and was held in position with a rubber band for 1 hour. Then, after the fabric was displaced, its surface side facing the liquid surface was inspected to find out whether dew condensation occurred or not.

Tensile Strength

Measured according to JIS L 1085 (lengthwise of the fabric). Unit: kgf/5 cm.

Rubbing Test

The sample, 5cm×15 cm, was firmly held at both ends thereof and rubbed 1+100 times. Then the surface of the sample was inspected to find the occurrence or non-occurrence of removal of particles.

The moisture-permeable, waterproof fabric of the present invention assures retaining heat generated by absorption of moisture, reduction of humidity within clothing and dewing inhibition, because highly moisture-absorbing and releasing, hygroscopically heat-generating organic fine particles are immobilized on the fabric with a moisture-permeable resin, and the fine particles evolve heat on absorption of moisture without hindrance.

We claim:

1. A heat-retaining, moisture-permeable, waterproof fabric having a highly moisture-absorbing and releasing organic fine particles immobilized on at least one surface of an unprocessed fabric (base fabric) with a moisture-permeable waterproof resin, said fabric (processed fabric) being capable of achieving a difference in the hygroscopic degree (ΔA) as represented by the following equation (1) and a difference in the temperature of heat generated by absorption of moisture (ΔT) as represented by the following equation (2):

$$\Delta A = A\ (95) - A\ (20) \geqq 3\ (\%) \quad (1)$$

wherein A (95) represents a moisture absorption ratio (%) of the processed fabric as measured after being left to stand for 24 hours at a relative humidity of 95% (20° C.), and A (20) represents a moisture absorption ratio (%) of the processed fabric as measured after being left to stand for 24 hours at a relative humidity of 20% (20° C.); and $$\Delta T = T\ (\text{sample}) - T\ (\text{blank}) \geqq 0.5\ (^\circ\text{C.}) \quad (2)$$

wherein T (sample) represents the surface temperature of the processed fabric as measured after the fabric is absolutely dried, adjusted to a temperature of 32° C. in an absolute dry condition and held for 10 seconds in an environment of 70% RH and 32° C., and T (blank) represents the surface temperature of the unprocessed fabric (base fabric) as measured after the fabric is absolutely dried, adjusted to a temperature of 32° C. in an absolute dry condition and held for 10 seconds in an environment of 70% RH and 32° C.

2. The heat-retaining, moisture-permeable, waterproof fabric according to claim 1, wherein the difference in the temperature of heat generated by absorption of moisture (ΔT) is in the range of about 1.0 to about 10.0° C.

3. The heat-retaining, moisture-permeable, waterproof fabric according to claim 2, wherein the difference in the temperature of heat generated by absorption of moisture (ΔT) is in the range of about 1.5 to about 8.0° C.

4. The heat-retaining, moisture-permeable, waterproof fabric according to claim 1, wherein the moisture-permeable, waterproof resin containing highly moisture-absorbing and releasing organic fine particles is immobilized in the form of a layer on at least one surface of the base fabric.

5. The heat-retaining, moisture-permeable, waterproof fabric according to claim 1, wherein the highly moisture-absorbing and releasing organic fine particles show an initial moisture-absorbing rate of 0.8%/min or more at 20° C. and 65% RH.

6. The heat-retaining, moisture-permeable, waterproof fabric according to claim 1, wherein the highly moisture-absorbing and releasing organic fine particles have an average particle size of 30 μm or less.

7. The heat-retaining, moisture-permeable, waterproof fabric according to claim 1, wherein the highly moisture-absorbing and releasing organic fine particles are the fine particles of an acrylic resin composed of at least 60% by weight of acrylonitrile as a monomer, the acrylic resin being given a crosslinked structure by hydrazine treatment, and the nitrogen content being increased by 1.0 to 15.0% by weight, at least 1.0 mmol/g of remaining nitrile group being chemically converted to a salt of carboxyl group by hydrolysis.

8. The heat-retaining, moisture-permeable, waterproof fabric according to claim 1, wherein the moisture-permeable, waterproof resin has a moisture permeability of at least 30 $g/m^2$.hr as measured in the form of a 30 μm-thick film.

9. The heat-retaining, moisture-permeable, waterproof fabric according to claim 8, wherein the moisture-permeable, waterproof resin has a moisture permeability of at least 70 $g/m^2$.hr.

10. The heat-retaining, moisture-permeable, waterproof fabric according to claim 4, wherein a layer of a resin having a thickness of 5 to 50 μm and a moisture permeability of 10 to 70 $g/m^2$.hr is formed on the layer of said moisture-permeable, waterproof resin containing highly moisture-absorbing and releasing organic fine particles.

11. The heat-retaining, moisture-permeable, waterproof fabric according to claim 1, wherein the amount of the highly moisture-absorbing and releasing organic fine particles is 1 to 100% by weight based on the fibers of the base fabric.

* * * * *